US005083815A

United States Patent [19]

Scrymgeour et al.

[11] Patent Number: 5,083,815

[45] Date of Patent: Jan. 28, 1992

[54] HEAT ACTUATED GAME

[75] Inventors: Lyle H. Scrymgeour; John H. Sanderson, both of Manitoba, Canada

[73] Assignee: Pollard Banknote Limited, Winnipeg, Canada

[21] Appl. No.: 515,218

[22] Filed: Apr. 27, 1990

[51] Int. Cl.[5] ..... B42D 15/00

[52] U.S. Cl. ..... 283/72; 283/102; 273/138 R; 273/139; 426/88; 116/216

[58] Field of Search ..... 273/138 R, 139; 283/72, 283/94, 102, 114, 901, 903, 111; 116/216; 374/162, 141, 159; 426/88

[56] References Cited

U.S. PATENT DOCUMENTS

| | | | |
|---|---|---|---|
| 1,676,536 | 7/1928 | Perkel | 116/216 X |
| 2,308,087 | 1/1943 | Lappala | 374/162 X |
| 2,753,270 | 7/1956 | Di Renzo | 116/216 |
| 3,826,499 | 7/1974 | Lenkoff . | |
| 4,174,857 | 11/1979 | Koza | 283/903 X |
| 4,464,064 | 8/1984 | Luzansky | 374/162 X |
| 4,466,614 | 8/1984 | Bachman et al. | 273/139 |
| 4,540,175 | 9/1985 | Coppock | 273/139 |
| 4,591,190 | 5/1986 | Clark | 283/903 X |
| 4,786,773 | 11/1988 | Keefer | 426/88 X |
| 4,829,539 | 5/1989 | Angus et al. | 374/162 X |
| 4,846,504 | 7/1989 | MacGregor et al. | 283/102 |
| 4,850,618 | 7/1989 | Halladay | 283/102 X |

FOREIGN PATENT DOCUMENTS

| | | | |
|---|---|---|---|
| 2163662 | 3/1986 | United Kingdom | 273/139 |
| 2188283 | 9/1987 | United Kingdom | 283/114 |

OTHER PUBLICATIONS

'Strike It Rich' advertisement for Mass. State Lottery, Jan. 1979.

'Instant Fortune' advertisement for Exxon Corp., Jul. 1977.

'Match The Superstar' Advertisement for Coca-Cola Promo., 1978.

*Primary Examiner*—Edward M. Coven

*Assistant Examiner*—Sebastiano Passaniti

*Attorney, Agent, or Firm*—Adrian S. Battison; Stanley G. Ade; Murray E. Thrift

[57] ABSTRACT

A lottery type game includes a plurality of indicia which can be exposed to reveal a winning or losing line and has a central indicium covered by scratchable ink and two other indicia covered by an ink which is normally opaque at room temperature but which becomes transparent on heating. The game can be used for the packaging of heatable food products or for other promotions relating to heating equipment.

2 Claims, 1 Drawing Sheet

HEAT ACTUATED GAME

BACKGROUND OF THE INVENTION

This invention relates to a game of the type which includes a plurality of indicia applied to a substrate which are initially hidden from view but are subsequently exposed and have some characteristic which indicates some games which are winners as opposed to other games which are merely losers. Games of this type are used as lottery type games which in many cases are bought as a simple card containing a number of covered indicia so that the player of the game can expose the indicia and can immediately indicate whether the card is a winner or a loser. In many cases the cards can be redeemed immediately for cash as indicated by the rules of the game which are generally printed on the card along with the incidia.

Various techniques for covering and exposing the indicia have previously been proposed. In one example the indicia are covered by a layer of ink which is then scratched away to expose the separately printed indicia beneath the layer of ink. In another example, the indicia are covered by a separate layer of paper or card which is perforated to enable it to be broken and torn away exposing the indicia printed on the underlying layer of card of paper. In another arrangement the indicia are printed in an ink which is invisible or transparent to the naked eye but which is rendered visible by the application of chemicals, for example solvents from a marker pen. This last technique has a relatively low level of security in that the ink while generally invisible to the naked eye can be activated by many different chemicals and in addition the ink while invisible to the naked eye often can be revealed by the use of ultra violet light.

One example of a device of the last type is shown in U.S. Pat. No. 3,826,499 (Lenkoff).

Lottery games of this type are highly popular and opportunity remains for significant success with any new lottery which provides an interesting level of novelty and enables different promotions for other products.

SUMMARY OF THE INVENTION

It is one object of the present invention, therefore, to provide a game which can be used as a lottery type game which has a unique technique for exposing the indicia which are initially hidden from view.

According to the first aspect of the invention there is provided a game comprising a substrate, a plurality of indicia applied by printing onto a surface of the substrate at a position for viewing by a player of the game, means rendering the indicia invisible at a first temperature so they cannot be read by the player, said means being actuable by a change in temperature thereof to render the indicia visible for reading by the player.

According to a second aspect of the invention there is provided a game comprising a substrate, a plurality of indicia applied to a surface of the substrate at a position for viewing by a player of the game the indicia including means for indicating a winning game, and a coating applied over the indicia, the coating having a colour characteristic such that at a first temperature the coating obscures the indicia to prevent reading thereof by the player and the coating being arranged upon a change of temperature thereof to vary the colour characteristic thereof to allow the indicia to become visible through the coating for reading of the indicia by the player.

According of a third aspect of the invention a game comprising substrate, a plurality of indicia applied to a surface of the substrate at a position for viewing by a player of the game, means rendering the indicia invisible at a first temperature so they cannot be read by the player, said means being actuable by a change in temperature thereof to render the indicia visible for reading by the player, wherein there is provided at least one further indicium and coating means obscuring the indicium, the coating means being removable only in a manner which leaves the indicium permanently exposed.

According to a fourth aspect of the invention a packaged food product comprising a food product, a packaging material containing the food product and designed to contain the food product while it is heated for consumption, the packaging material carrying indicia which are invisible at a first temperature of the packaging material and which are rendered visible by a change in temperature thereof, the indicia comprising a lottery type game.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

The game of the present invention is mounted on a substrate 10 formed for example of paper or card or other suitable material on which printing can be applied. Upon the substrate 10 three indicia 11, 12 and 13 are printed each of which forms a readable character or information forming part of the game.

Figure 4:
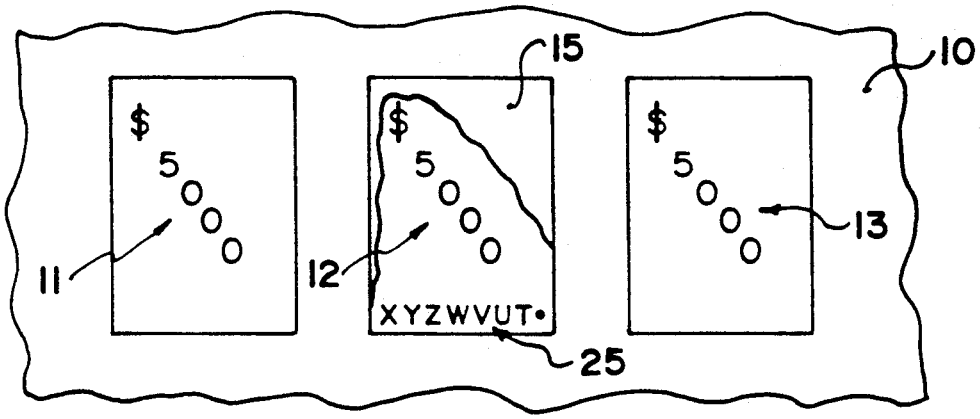
FIG. 4 is an enlarged view of the indicia of the game.

As shown in FIG. 4 the indicia comprise the words "$5,000".

The example shown in FIG. 4 comprises a winning example of a simple conventional lottery game in which the matching of three symbols or characters leads to the winning of a prize. In this very simple example the prize itself is set out as the characters or indicia concerned.

Figure 1:
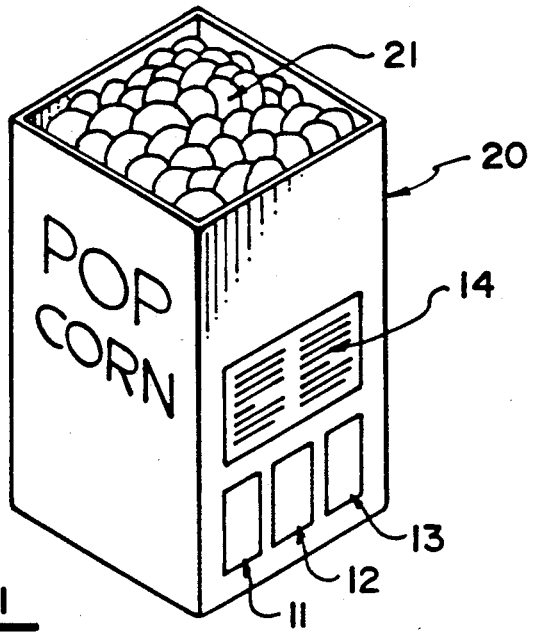
FIG. 1 is an isometric view of a packaged food product including a game according to the present invention.
Figure 2:
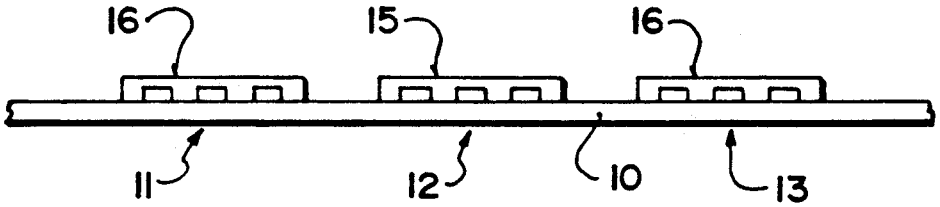
FIG. 2 is a cross sectional view through a portion of the packaging of the product of FIG. 1 showing the indicia applied thereto.
Figure 3:
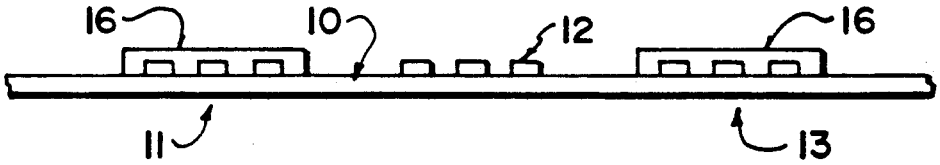
FIG. 3 is a further cross sectional view indentical to that of FIG. 2 but subsequent to the action upon the indicia for exposing of the indicia.

In other examples a winning line is provided by three symbols of various different types which are all equal. Other winning lines or combinations can also be provided and generally the winning combinations are set out in the rules of the game indicated at 14 which are printed with the indicia as shown in FIG. 1.

On top of the central one of the three indicia is provided a layer of removable ink indicated at 15. As shown in FIG. 4 a part of the ink has been removed exposing the indicium 12 underneath. Normally the ink 15 obscures the indicium so that it cannot be read by the player of the game until the ink is removed by scratching or other similar action. Once the ink is of course removed it is permanently removed so that the indicium is then exposed and it is shown that the game concerned has been at least partly played.

The indicia 11 and 13 on the outside of the central inducium are covered by a layer 16 of ink which is of a character which remains permanently in place and basically cannot be scratched away from the surface in the conventional simple manner of the scratchable ink and is intended to remain permanently in place.

The ink 16 is of a character which is opaque at one temperature thus masking or hiding or rendering invisible the indicium covered by the ink 16. Furthermore, the ink is of a character which changes colour characteristic upon a change in temperature rendering the indicium 11 or 13 visible.

The formulation of ink set out hereinafter has the characteristics that it changes from the opaque or masking condition at a temperature of the order of 50° C. or above. This is greater than a temperature which can be achieved by a person touching or blowing upon the product to apply body heat to the product. It is necessary therefore to achieve the temperature of 50° C. for the product to be heated by a suitable heating appliance. Such a heating appliance may comprise a microwave oven, a conventional radiant heating oven, a blow dryer or other equipment which generates heat which can be applied simply to the ink 16 and to the substrate.

Furthermore the ink has the characteristic that once it is heated to the temperature above 50° C. and becomes sufficient transparent for the indicia to be visible and readable, it retains the changed condition for a period greater than one hour and preferably in the range of one hour to twenty-four hours.

The time period for which the product maintains the transparent effect of the layer 16 is arranged to be sufficient that the product can be heated, removed from the heating process and inspected at the leisure of the player without necessity for rapid action before the visibility of the indicia is removed. In addition, the time period is preferably sufficient to maintain security so that it becomes obvious that a number of the games have been heated because they retain the changed condition for a sufficient period of time for an authorized person to observe the unauthorized use.

As shown in FIG. 1, the substrate forms part of a package 20 which is intended to contain a food product 21 in this example, popcorn which is heated while retained within the packaging. It is intended therefore that the whole of the product including the food product, the packaging and the game would be inserted into a microwave oven or other similar heating device and heated to provide heating or cooking effect on the food. The whole product can then be removed, the food product eaten and the game played by the user.

In the operation of the game, the player will generally scratch away the layer 15 to expose the indicium of the central area. This action indicates that the beginning of the game has been played and hence it is not possible for the product to be replaced if a winning line is not obtained. The player then activates the layer 16 to change from the opaque condition to the transparent condition exposing the indicia at the two outside positions. A winning line is then immediately apparent on inspection of the exposed indicia as shown in FIG. 4. Of course only a limited number of winning lines will be provided in the total number of games produced. A winning line is then of course collected from the packaging and the cash prize or other prize can be obtained by redeeming by the game substrate and indicia at an authorized dealer of the products.

The central indicium can include a second area indicated at 25 in the form of a code which is not readily discernible by the player but which would indicate to the authorized dealer that the card is indeed a winning card without the necessity for heating the outer two indicia. At the time of inspection, it may of course be that the ink 16 is returned to the initial opaque condition so that the authorized user can tell without viewing the outside indicia, from the central indicia alone, that the card is a winning card.

In one example as shown in FIG. 1, the game is applied to a food product where heating action is of course necessary to render the food product in a condition for eating. The game therefore acts as a novelty item on the food product to encourage sales of a particular food product as opposed to other products which do not the enhanced enjoyment of the game.

In further examples (not shown) the game can constitute merely a simple card which would be attached to a heating product for example, blow dryer, as a promotion for that product and again to encourage purchasers to obtain the enhanced product rather than the product which does not carry the game. The blow dryer can then be used for the first time to heat the promotional card to determine whether the card is a winning card or merely one of the many losing cards.

The ink formulation for effecting these characteristics is known to one skilled in that art and it is not necessary to set out the formulation here. Various examples of ink of this type known as chromatic ink are known for use on toys and in determining whether a product has been sterilized by heating.

While the above examples have been concerned with products that are opaque thus covering the indicia at room temperature and become exposed on heating, in an alternative embodiment of the invention, the indicia of the game are masked at a reduced temperature of the order of that found in a conventional store or home freezer and become exposed at room temperature. Thus the purchaser can obtain the product while frozen and the indicia masked and can see whether they have a winning game when the packaging is sufficiently thawed to change the ink characteristics.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A game apparatus comprising a plurality of substrates having a plurality of indicia applied to a portion of a surface of each of said plurality of substrates for viewing by a player of the game, each of said plurality of substrates having thereon means rendering the indicia thereof invisible at a first temperature so that the indicia cannot be read by the player, said means being actuable by a change in temperature thereof to a temperature significantly greater than that obtainable by simple contact with the body heat of the player to render the indicia visible for reading by the player, wherein there is provided on each of said plurality of substrates at least one further indicium and coating means obscuring said further indicium, the coating means being removable only in a manner which leaves the further indicium permanently exposed, wherein a winning substrate is indicted by the presence of a common indicium both on each of the indicia of the winning substrate of said plurality of substrates, and on said at least one further indicium of the winning substrate.

2. The invention according to claim 1 wherein the means rendering the indicia invisible is actuable so that the indicia are rendered visible for a period of time greater than one hour.

* * * * *